US008613339B2

(12) United States Patent
Baba

(10) Patent No.: US 8,613,339 B2
(45) Date of Patent: Dec. 24, 2013

(54) AUTOMATIC TRANSFER APPARATUS

(75) Inventor: Hiroyoshi Baba, Toyota (JP)

(73) Assignee: Toyota Jidosha Kabushiki Kaisha, Toyota-Shi (KP)

( * ) Notice: Subject to any disclaimer, the term of this patent is extended or adjusted under 35 U.S.C. 154(b) by 412 days.

(21) Appl. No.: 12/676,872

(22) PCT Filed: Sep. 5, 2008

(86) PCT No.: PCT/JP2008/066485

§ 371 (c)(1), (2), (4) Date: Mar. 5, 2010

(87) PCT Pub. No.: WO2009/031707

PCT Pub. Date: Mar. 12, 2009

(65) Prior Publication Data

US 2010/0212984 A1 Aug. 26, 2010

(30) Foreign Application Priority Data

Sep. 6, 2007 (JP) ..... 2007-231424

(51) Int. Cl.
*B62D 1/24* (2006.01)

(52) U.S. Cl.
USPC ..... 180/168

(58) Field of Classification Search
USPC ..... 180/167, 168, 169, 218, 264, 267, 180/24.03, 13, 236; 701/22, 23
See application file for complete search history.

(56) References Cited

U.S. PATENT DOCUMENTS

| | | | | |
|---|---|---|---|---|
| 5,901,805 | A * | 5/1999 | Murakami et al. | 180/168 |
| 6,237,504 | B1 * | 5/2001 | Tanahashi et al. | 104/243 |
| 6,481,521 | B2 * | 11/2002 | Sugiyama et al. | 180/168 |

FOREIGN PATENT DOCUMENTS

| | | | |
|---|---|---|---|
| JP | 58-116259 | | 7/1983 |
| JP | 59-195463 | A | 11/1984 |
| JP | 1989-16967 | U | 1/1989 |
| JP | 1-266056 | A | 10/1989 |
| JP | 5-108155 | A | 4/1993 |
| JP | 5-112238 | A | 5/1993 |
| JP | 8-123550 | A | 5/1996 |
| JP | 11-265211 | A | 9/1999 |
| JP | 2000-330635 | | 11/2000 |
| JP | 2006-31343 | A | 2/2006 |

* cited by examiner

*Primary Examiner* — Katy M Ebner
(74) *Attorney, Agent, or Firm* — Kenyon & Kenyon LLP

(57) ABSTRACT

In an automatic transfer apparatus, a carriage tractor and a carriage are respectively equipped with connecting portions and through which the carriage tractor is connected near the substantial center of the bottom of the carriage. The automatic transfer apparatus is provided with displacement restricting means for restricting lateral displacement of the carriage tractor or the carriage with respect to the running direction thereof when the carriage tractor runs in the traverse direction while towing the carriage. Therefore, the carriage tractor is capable of running in the forward-reverse direction and the traverse direction while simplifying and downsizing the structure of the carriage tractor.

5 Claims, 8 Drawing Sheets

1
2a
6
10a
7
25a
8
3
10c
4
15, 16a
25c
24
10b
25b
10d
16b
25d
2

15, 16b 36b
36
36a
35
2b

F I G. 3
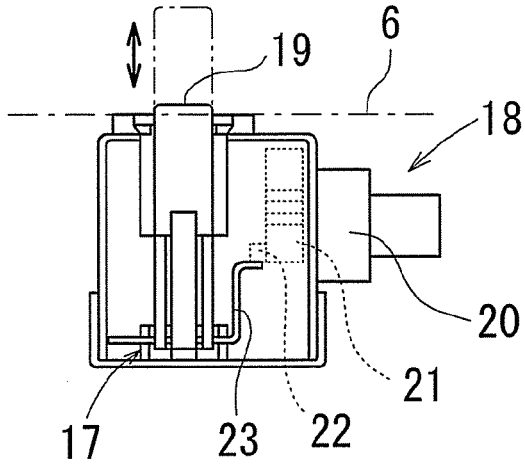
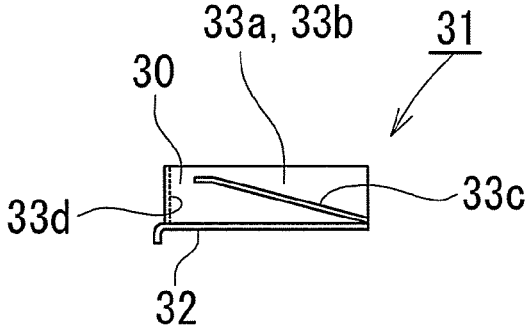
F I G. 4 (c)
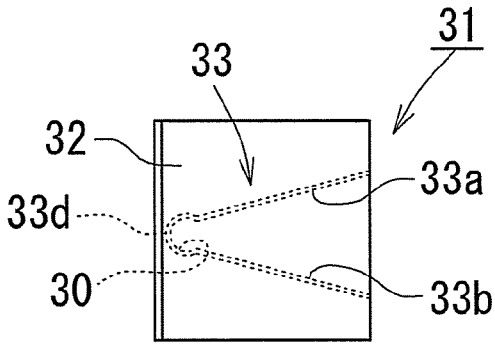
F I G. 4 (a)
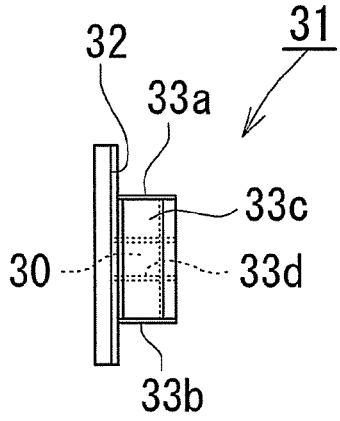
F I G. 4 (b)

AUTOMATIC TRANSFER APPARATUS

This is a 371 national phase application of PCT/JP2008/066485 filed 5 Sep. 2008, claiming priority to Japanese Patent Application No. 2007-231424 filed 6 Sep. 2007, the contents of which are incorporated herein by reference.

FIELD OF THE INVENTION

The present invention relates to an automatic transfer apparatus equipped with a self-propelled transfer vehicle that has a connecting portion connecting with a carriage carrying workpieces or loads and that runs by self-propulsion along a predetermined path.

BACKGROUND OF THE INVENTION

There has been conventionally known an automatic transfer apparatus equipped with a self-propelled transfer vehicle such as a tractor type self-propelled vehicle (hereinafter called a carriage tractor) that is attachable and detachable through a connecting portion to a carriage loaded with workpieces or loads and runs by self-propulsion along a predetermined path by using guiding means such as magnetic information laid on a floor surface while towing the carriage, or a carrier type self-propelled vehicle that is integrated through a connecting portion with a carriage loaded with workpieces or loads and runs by self-propulsion along the predetermined path by using the guiding means such as the magnetic information laid on the floor surface.

Now, as shown in FIG. 12, a carriage tractor 50 employed in the conventional automatic transfer apparatus is always integrally connected with a carriage 4 near the substantial center thereof. In addition, the carriage tractor 50 is arranged with two units (2WD+2WS) of drive wheel units 7, 7 having a pair of independently rotating right and left wheels 8, 8, in a manner separated from each other in the front-rear direction. Note that idler wheels 25*a* to 25*d* are respectively provided at four corners of the bottom of the carriage 4.

In recent years, effective use of the automatic transfer apparatus tends to increase. Moreover, it is sought to downsize the carriage tractor so as to enable running in a small space for higher efficiency, and it is also sought to achieve lower cost.

However, in order to configure the carriage tractor (2WD+2WS) 50 having the complicated structure as shown in FIG. 12 so as to be capable of running in the traverse direction converted from the forward-reverse direction, each of the two drive wheel units 7, 7 needs to be additionally provided with such a device as a steering control motor or a steering angle sensor to convert the direction of the drive wheel units 7, 7 from the forward-reverse direction to the traverse direction as shown in FIG. 12B. Therefore, the structure becomes further complicated, disabling the downsizing. In addition, in the case in which the carriage tractor 50 is configured to have one drive wheel unit 7 for downsizing the carriage tractor 50, when the carriage tractor 50 runs in the traverse direction while towing the carriage 4, the carriage 4 is laterally displaced with respect to the running direction to result in running in an oblique direction at the time when the idler wheels 25*a* to 25*d* of the carriage 4 convert the direction thereof from the forward-reverse direction to the traverse direction. Therefore, in order to restrict the lateral displacement of the carriage 4 with respect to the running direction thereof, the carriage tractor 50 requires enough driving force to overcome the force displacing the carriage 4. Consequently, it is required to make the drive wheel unit 7 extremely large or to increase the number thereof to at least two units or more, thereby making difficult to downsize the carriage tractor 50.

It should be noted that, as a related art of the automatic transfer apparatus, Patent Document 1 describes a four-wheel steering type unmanned transfer vehicle that is an unmanned transfer vehicle switchable between travel and traverse. The unmanned transfer vehicle is provided, on the lower surface thereof, with four running wheels having steering means for making steer angles of the wheels controllable independently of each other, and two of the running wheels arranged on the diagonal line of the transfer vehicle are provided with running drive motors so as to enable travel and traverse, thereby maintaining equilibrium of driving force with respect to the transfer vehicle and obtaining running stability.

Patent Document 1: Japanese Patent Application Publication No. JP-A-8-123550

SUMMARY OF THE INVENTION

Problems to be Solved by the Invention

However, in the invention of Patent Document 1, because the four running wheels of the transfer vehicle are provided with the steering means making the steer angles of the wheels controllable independently of each other, the structure of the transfer vehicle becomes complicated, disabling the downsizing and the cost reduction, thus failing to eliminate the problem described above.

In view of the problems described above, it is an object of the present invention to provide an automatic transfer apparatus that enables running of a self-propelled transfer vehicle in the forward-reverse direction and the traverse direction while simplifying and downsizing the structure of the self-propelled transfer vehicle such as a carriage tractor.

Means for Solving the Problems

In order to solve the problems described above, an automatic transfer apparatus of the present invention is characterized in that: a displacement restricting means is provided for restricting lateral displacement of a carriage in its running direction when a self-propelled transfer vehicle runs in a traverse direction; the displacement restricting means is provided with a pair of carriage position holding guides that holds a position of the carriage on a traverse guide path where the self-propelled transfer vehicle runs in the transverse direction, or a drive wheel provided at the self-propelled transfer vehicle is composed of a drive wheel unit having a pair of right and left wheels rotating independently of each other; the drive wheel unit is provided at one place in a substantial center of the bottom of the self-propelled transfer vehicle; and the direction of the drive wheel unit is converted by differentiating rotational speeds of each of the wheels.

Consequently, the automatic transfer apparatus is capable of enabling the running of the self-propelled transfer vehicle in the forward-reverse direction and the traverse direction while simplifying and downsizing the structure of the self-propelled transfer vehicle.

Note that various forms of the automatic transfer apparatus of the present invention and operations thereof will be described in detail in the following items of exemplary forms of the invention.

Exemplary Forms of the Invention

Several forms of the invention that are recognized to be capable of being claimed for patent in the present application (hereinafter may be called "claimable invention") will be exemplified and described below. Note that, similarly to the claims, the forms are classified into items, and the items are assigned with numbers and described in the form of citation of other items as required. This is solely for the purpose of facilitating understanding of the claimable invention, and not for limiting the combination of the components composing the claimable invention to those described in the items below. That is, the claimable invention should be interpreted in the light of the description associated with each item, of embodiments, and so on. As far as conforming to such an interpretation, not only a form provided by adding another component to a form of each item but also a form provided by removing a component from a form of each item can serve as a form of the claimable invention. Note that among the items listed below, each of items (1) to (5) corresponds to each of claims 1 to 5, respectively.

(1) An automatic transfer apparatus equipped with a self-propelled transfer vehicle that runs, by using a travel magnetic tape and a travel indication marker laid along a predetermined path, along the predetermined path in a forward-reverse direction and a traverse direction, and has a connecting portion connecting with a carriage is characterized in that: a displacement restricting means is provided for restricting lateral displacement of the carriage in its running direction when the self-propelled transfer vehicle runs in a traverse direction; the displacement restricting means is provided with a pair of carriage position holding guides that holds a position of the carriage on a traverse guide path where the self-propelled transfer vehicle runs in the transverse direction, or a drive wheel provided at the self-propelled transfer vehicle is composed of a drive wheel unit having a pair of right and left wheels rotating independently of each other; the drive wheel unit is provided at one place in a substantial center of the bottom of the self-propelled transfer vehicle; and the direction of the drive wheel unit is converted by differentiating rotational speeds of each of the wheels.

Accordingly, in the automatic transfer apparatus according to item (1), because the displacement restricting means is capable of restricting the lateral displacement of the self-propelled transfer vehicle and the carriage with respect to the running direction thereof when the self-propelled transfer vehicle runs in the traverse direction, there is no need to increase driving force of the self-propelled transfer vehicle by increasing the number of drive wheels and so on, thus enabling to simplify the structure of the self-propelled transfer vehicle. Further, since the displacement restricting means is structured by including the pair of carriage position holding guides that holds the position of the carriage on the traverse guide path on which the self-propelled transfer vehicle runs in the traverse direction, it is possible to easily restrict the lateral displacement of the self-propelled transfer vehicle and the carriage in their running directions with a simple structure when the self-propelled transfer vehicle runs in the traverse direction. Still further, since the drive wheel unit is provided at only one place in the self-propelled transfer vehicle, the structure of the self-propelled transfer can be further simplified. Moreover, running motors are respectively connected to the pair of right and left wheels of the drive wheel unit, so that the direction of the drive wheel unit can be converted by differentiating the rotational speeds of the running motors.

(2) The automatic transfer apparatus according to item (1) is characterized in that a detecting sensor detecting the travel magnetic tape is built into a front portion or a rear portion in a forward direction of a drive wheel, and, based on detection of the travel magnetic tape by the detecting sensor, the direction of the drive wheel is converted to either of the forward-reverse direction and the traverse direction.

Accordingly, in the automatic transfer apparatus according to item (2), because the direction of the drive wheel is converted to either of the forward-reverse direction and the traverse direction based on the detection of the guiding means by the detecting sensor, there is no need to newly provide a component such as a steering control motor or a steering angle sensor for controlling the direction of the drive wheel, thus further enabling to simplify the structure of the self-propelled transfer vehicle.

(3) The automatic transfer apparatus according to any one of items (1) to (2) is characterized in that the self-propelled transfer vehicle is a carriage tractor that is connected to the carriage in a detachable manner and tows the carriage, and the carriage tractor and the carriage are respectively provided with connecting portions through which the carriage tractor is connected near the substantial center of the bottom of the carriage.

Accordingly, in the automatic transfer apparatus according to item (3), in the case that the self-propelled transfer vehicle is the carriage tractor that tows the carriage, because the carriage tractor is connected to the carriage through the connecting portions near the substantial center of the bottom of the carriage, it is possible to minimize the lateral displacement of the carriage tractor and the carriage with respect to the running direction thereof when the carriage tractor runs in the traverse direction.

(4) The automatic transfer apparatus according to any one of items (1) to (3) is characterized in that the carriage position holding guides are composed of: a pair of guide plates that is arranged upright from each side of the floor surface of the traverse guide path through the travel magnetic tape and extends in the same direction as that of the travel magnetic tape; and a plurality of rotatable rollers that are provided on the surface of the guide plates along the direction in which the travel magnetic tape extends and make contact with the both lateral surfaces of the shorter sides of carriage bodies of the carriages.

(5) The automatic transfer apparatus according to any one of items (1) to (3) is characterized in that the carriage position holding guides are composed of: a pair of guide plates that is arranged upright from each side of a floor surface of the traverse guide path through the travel magnetic tape and extends in the same direction as that of the travel magnetic tape; and a pair of rotatable rollers that is provided at a front and a back of the carriage along a direction in which the travel magnetic tape extends, the rotatable rollers each rotated along the pair of guide plates.

Effects of the Invention

According to the present invention, it is possible to provide an automatic transfer apparatus that enables the running of the self-propelled transfer vehicle in the forward-reverse direction and the traverse direction while simplifying and downsizing the structure of the self-propelled transfer vehicle such as the carriage tractor.

BRIEF DESCRIPTION OF THE DRAWINGS

FIG. 3 is a front view of a pin driving mechanism composing a connecting portion of the carriage tractor of the automatic transfer apparatus.

FIGS. 4(*a*)-4(*c*) show three orthographic views of a pin engaging member composing a connecting portion of a carriage of the automatic transfer apparatus.

DESCRIPTION OF THE REFERENCE NUMERALS

Figures 1A, 1B, 1C, 1D, 1E, 1F:
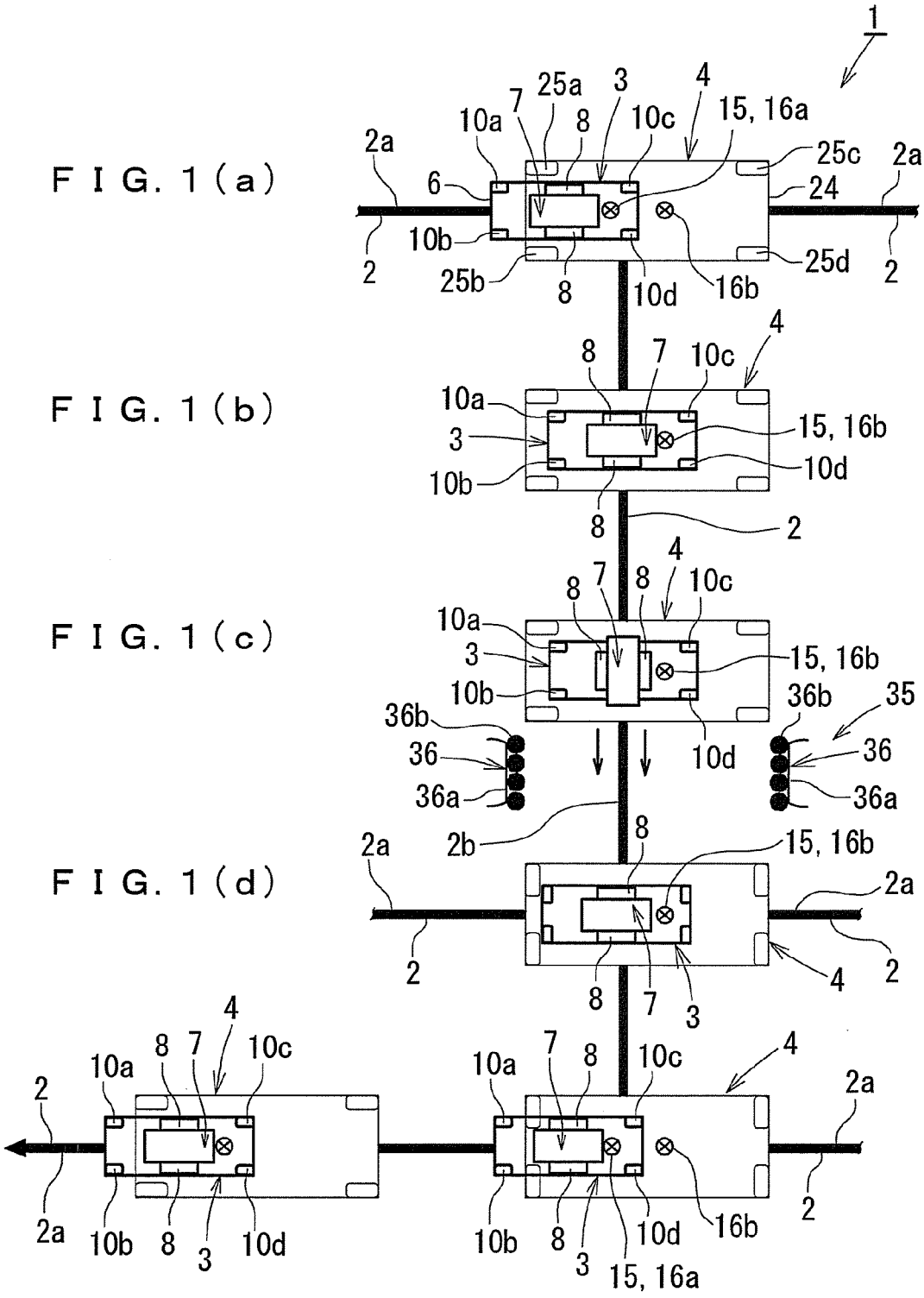
FIGS. 1(*a*)-1(*f*) show schematic diagrams illustrating an automatic transfer apparatus according to an embodiment of the present invention.

1 Automatic transfer apparatus, 2 Travel magnetic tape, 2*a* Forward-reverse guide path, 2*b* Traverse guide path, 3 Carriage tractor (self-propelled transfer vehicle), 4 Carriage, 7 Drive wheel unit (drive wheels), 8 Wheel (drive wheel), 12 Magnetic detection sensor unit, 13*a* to 13*c* Magnetic detection sensors, 15 Connecting portion, 16*a* and 16*b* Connecting portions, 19 Connection pin, 18 Pin driving mechanism, 30 Pin engaging hole, 31 Pin engaging member, 35 Displacement restricting means, 36 Carriage position holding guide, 36*a* Guide plate, 36*b* Rotatable roller

DETAILED DESCRIPTION

Best modes for carrying out the present invention will be described in detail below based on FIGS. 1 to 11. Note that the same members as those of the related art example shown in FIG. 12 will be described by using the same reference numerals.

FIG. 1 shows schematic diagrams of an automatic transfer apparatus 1 according to an embodiment of the present invention, the diagrams illustrating a situation in which a carriage tractor (self-propelled transfer vehicle) 3 runs along a travel magnetic tape 2 in the traverse direction converted from the forward-reverse direction while towing a carriage 4.

Note that, although the automatic transfer apparatus 1 according to the embodiment of the present invention employs as the self-propelled transfer vehicle the carriage tractor 3 that is connected to the carriage 4 in a detachable manner and tows the carriage 4, the present invention may obviously be applied to a carrier type self-propelled vehicle that is integrated with the carriage 4 through a connecting portion.

As shown in FIG. 1, the automatic transfer apparatus 1 according to the embodiment of the present invention mainly includes the travel magnetic tape 2 and travel indication markers laid on a floor surface of a predetermined path, the carriage tractor 3 that runs by self-propulsion along the travel magnetic tape 2 and is capable of running in the forward-reverse direction and the traverse direction, the carriage 4 that is connected to the carriage tractor 3 in a detachable manner and on which workpieces or loads are loaded, and displacement restricting means 35 that restricts lateral displacement of the carriage 4 with respect to the running direction thereof when the carriage tractor 3 runs in the traverse direction converted from the forward-reverse direction to while towing the carriage 4.

Note that, in the description below, the words "front" and "rear" used for describing arrangement of component members and so on are used in the sense of the forward-reverse running direction of the carriage tractor 3. In addition, the word "lateral" is used in the sense of the direction intersecting with the running direction of the carriage tractor 3.

As shown in FIG. 1, the travel magnetic tape 2 is laid on the floor surface so as to form crank-shaped guide paths for the carriage tractor 3, and forms forward-reverse guide paths 2*a* that allow the carriage tractor 3 to run in the forward-reverse direction and a traverse guide path 2*b* that intersects substantially perpendicularly to the forward-reverse guide paths 2*a* and allows the carriage tractor 3 to run in the traverse direction converted from the forward-reverse direction.

In addition, the travel indication markers (not shown) are installed in a plural number at intervals along the travel magnetic tape 2. The system of the travel indication markers is divided into an absolute addressing system in which the markers themselves have a plurality of travel indications and a relative addressing system in which the markers themselves do not have the travel indications but the carriage tractor 3 has a traveling program, using the markers for counting up in the traveling program.

The carriage tractor 3 runs by self-propulsion along the travel magnetic tape 2 and the travel indication markers by using a magnetic detection sensor unit 12 and a travel indication marker detection sensor (not shown) installed at a front portion or a rear portion in the forward direction of a drive wheel unit 7. One piece of the drive wheel unit 7 is provided at the substantial center of the bottom of a carriage tractor body 6. The drive wheel unit 7 is structured such that running motors (not shown) are respectively connected to a pair of wheels 8, 8 provided on the right and the left so as to rotate the wheels 8, 8 independently. In addition, the carriage tractor 3 is capable of running in the forward and the reverse directions by forward and reverse rotations of the running motors and by fixed/swivel switching control of idler wheels 10*a* to 10*d*.

Moreover, the carriage tractor 3 is provided with the idler wheels 10*a* to 10*d* at four corners of the bottom of the carriage tractor body 6. Each of the idler wheels 10*a* to 10*d* is set as a swivel idler wheel that is freely revolvable about a vertical axis, or as a fixed idler wheel that is fixed so as to be oriented in the forward-reverse direction, at appropriate times.

Figure 9:
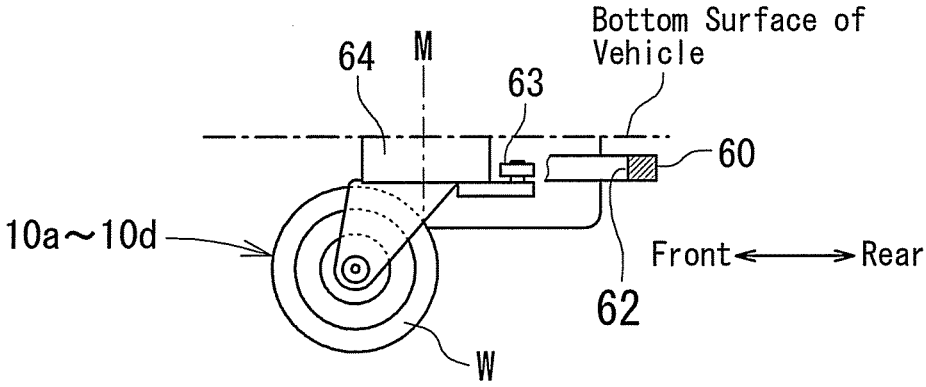
FIG. 9 is a schematic side view of a wheel switching unit of each idler wheel of the carriage tractor.
Figure 10:
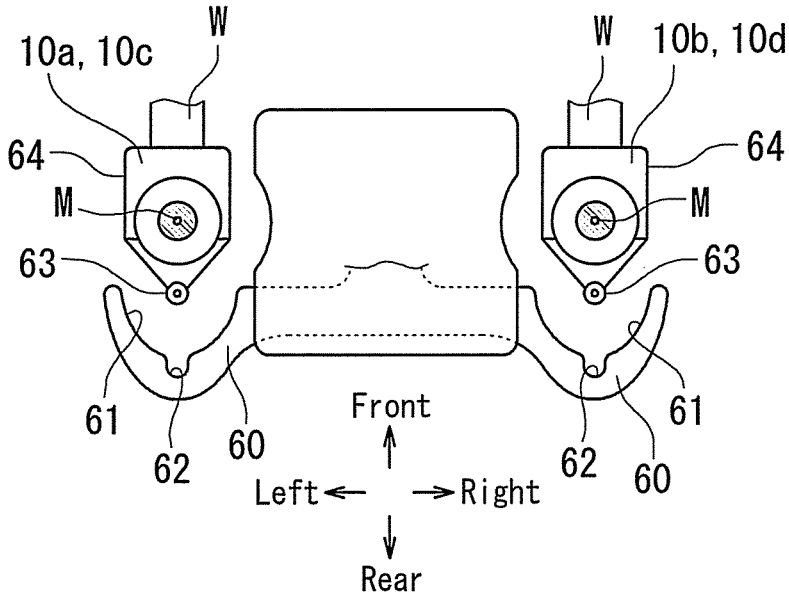
FIG. 10 is a schematic plan view of the wheel switching unit of each idler wheel of the carriage tractor.
Figure 11:
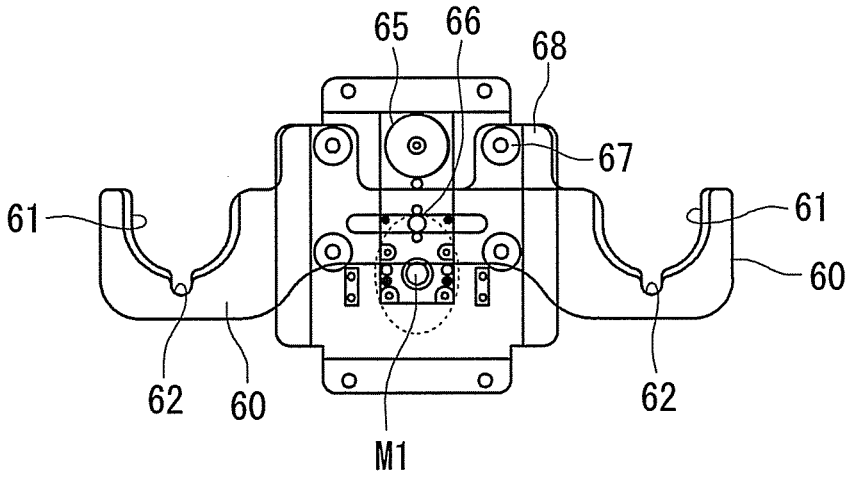
FIG. 11 is a schematic cross-sectional view of the wheel switching unit of each idler wheel of the carriage tractor.
Figures 12A, 12B, 12C, 12D, 12E:
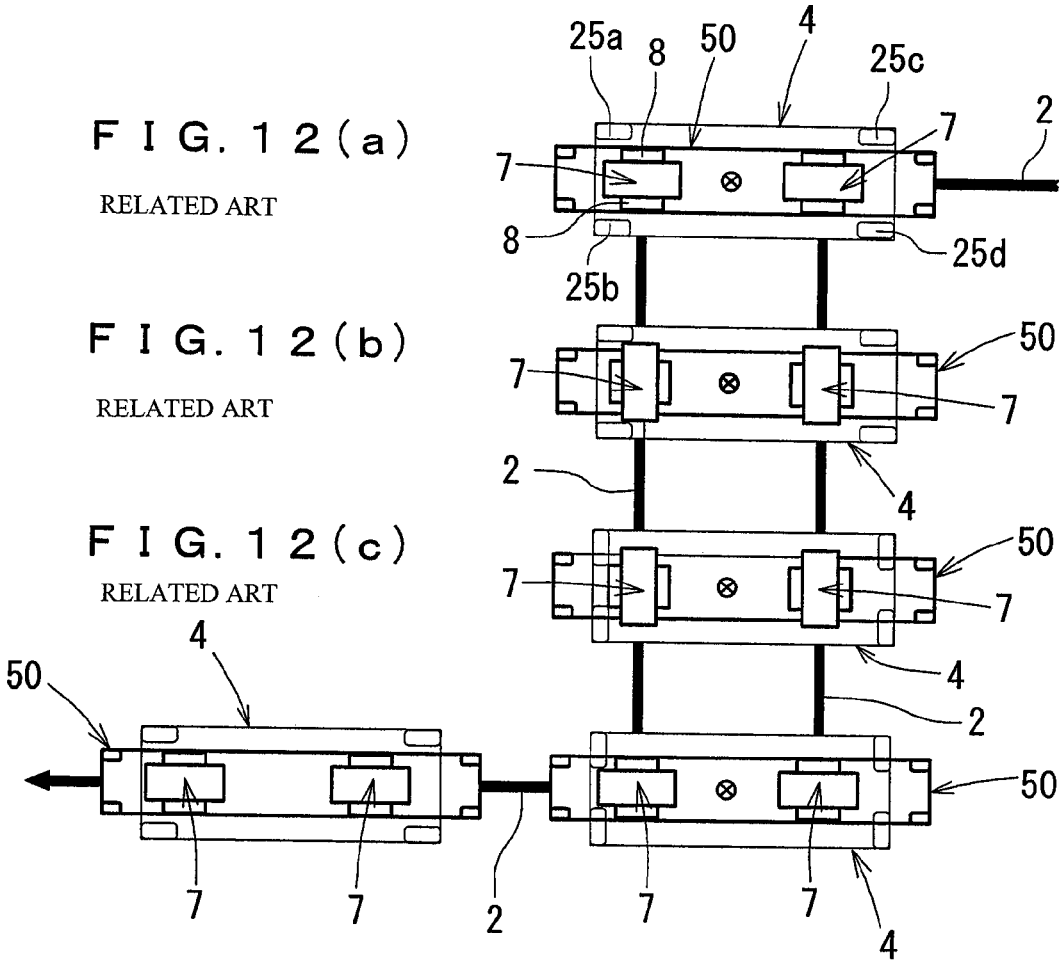
FIG. 12(a) RELATED ART
FIG. 12(b) RELATED ART
FIG. 12(c) RELATED ART
FIG. 12(e) RELATED ART
FIG. 12(d) RELATED ART
FIGS. 12(*a*)-1(*e*) show schematic diagrams illustrating a related art automatic transfer apparatus.

Specifically, as shown in FIGS. 9 to 11, each of the idler wheels 10*a* to 10*d* of the carriage tractor 3 is basically a swivel wheel; a positioning roller 63 is installed on a wheel holding portion 64; wheel switching units are installed at the front and the rear of the carriage tractor 3 in order to constrain wheels W; and the fixed/swivel switching of each of the idler wheels 10*a* to 10*d* is performed by controlling a wheel switching plate 60. Note that reference numeral M shown in FIGS. 9 to 11 represents the vertical axis supporting each of the idler wheels 10*a* to 10*d* so as to be freely oriented. Reference numeral W shown in FIGS. 9 to 11 represents the wheel.

For example, a case will be described in which the idler wheels 10*a* and 10*b* are set as fixed wheels.

When a cam 66 is rotated about a rotation axis M1 by controlling a clamping motor 65 in the wheel switching unit, the wheel switching plates 60 move in the front-rear direction (upper-lower direction viewed in the drawing) of the carriage tractor 3 while being restricted by guide rollers 67 and guides 68. Then, when the wheel switching plates 60 move in the front-rear direction, the positioning rollers 63 come into contact with U-shaped grooves 61 of the wheel switching plates 60 and move along the U-shaped grooves 61, thereby orienting directions of the wheels W in the front-rear direction. Subsequently, when the positioning rollers 63 have finally engaged with positioning notches 62 provided in the wheel switching plates 60, the directions of the wheels W are fixed in the state of being oriented in the front-rear direction. Then, the idler wheels 10*a* and 10*b* function as fixed wheels.

On the other hand, when switching the idler wheels 10*a* and 10*b* to the swivel wheels, the wheel switching plates 60 are moved in the direction separating from the positioning rollers 63 of the wheel holding portions 64 (downward viewed in the drawing). As a result, the idler wheels 10*a* and 10*b* are freed from the constrained state as fixed wheels, thereby subsequently functioning as swivel wheels.

Figure 2:
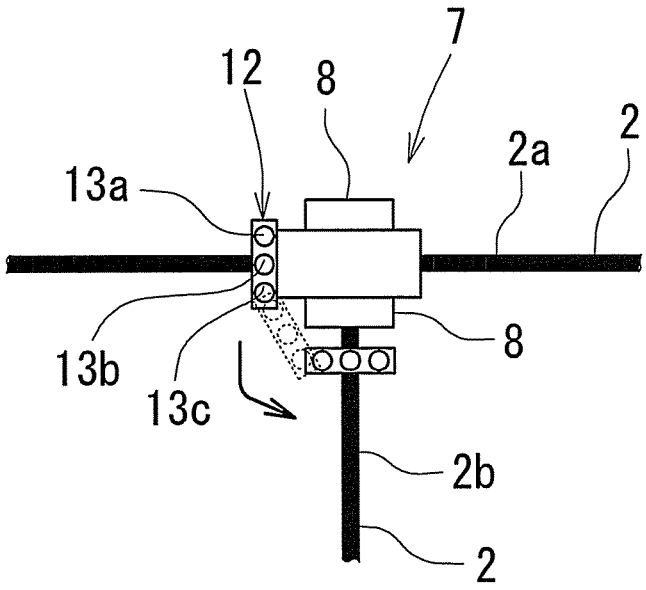
FIG. 2 is a diagram showing a situation of converting the direction of a drive wheel unit in a carriage tractor of the automatic transfer apparatus.

As shown in FIG. 2, the magnetic detection sensor unit 12 that detects the travel magnetic tape 2 is arranged at the front portion in the forward direction of the drive wheel unit 7. The magnetic detection sensor unit 12 is structured by being arranged with a plurality (three in the present embodiment) of magnetic detection sensors 13*a* to 13*c* in the direction substantially perpendicular to the direction in which the travel magnetic tape 2 extends. Note that the magnetic detection sensor unit 12 may be arranged at the rear portion in the forward direction of the drive wheel unit 7.

Usually, as shown in FIGS. 1 and 2, when the carriage tractor 3 runs on the travel magnetic tape 2, the three magnetic detection sensors 13*a* to 13*c* detect the travel magnetic tape 2 so as to achieve the detection state of OFF, ON, and OFF in the corresponding order, and the rotational speeds of the running motors of the wheels 8, 8 are controlled.

As shown in FIG. 1, the carriage tractor 3 is provided with a connecting portion 15 connecting with the carriage 4 at the rear side of the drive wheel unit 7. The connecting portion 15 is structured, for example, such that a pin driving mechanism 18 is built into the carriage tractor body 6, as shown in FIG. 3. The pin driving mechanism 18 is composed of a connection pin 19 installed in a manner capable of protruding from and receding into the carriage tractor body 6, a spring push-up mechanism 17 arranged at the lower end of the connection pin 19, a motor 20 rotatably mounted to the carriage tractor body 6 with the shaft line thereof horizontally oriented, a cam 21 driven by the motor 20 and a cam follower 22, and a connecting member 23 arranged between the spring push-up mechanism 17 and the cam follower 22.

Then, when the motor 20 rotates the cam 21, the connection pin 19 can protrude from and recede into the carriage tractor body 6 through the cam follower 22 and the connecting member 23.

As shown in FIG. 1, the carriage 4 is provided with idler wheels 25*a* to 25*d* at four corners of the bottom of a carriage body 24. All of the idler wheels 25*a* to 25*d* are set as swivel idler wheels revolvable about vertical axes.

In addition, the carriage 4 is provided with connecting portions 16*a* and 16*b* arranged in the front-rear direction that connect with the carriage tractor 3 near the substantial center of the bottom of the carriage body 24. For example, as shown in FIG. 4, each of the connecting portions 16*a* and 16*b* is provided with a pin engaging member 31 having a pin engaging hole 30, and the pin engaging member 31 is provided with an introducing member 33 on the lower surface of a rectangular plate 32 thereof. The introducing member 33 is composed of a pair of sidewall portions 33*a* and 33*b* whose separation width between each other gradually increases from the front edge toward the rear edge of the rectangular plate 32, a cylindrical portion 33*d* to which the front ends of the pair of sidewall portions 33*a* and 33*b* are connected, and a ceiling wall portion 33*c* that is located between the both sidewall portions 33*a* and 33*b*, and gradually reduced in height from the front edge toward the rear edge of the rectangular plate 32. Consequently, the pin engaging hole 30 of a circular shape is formed in the cylindrical portion 33*d* at the junction of the pair of sidewall portions 33*a* and 33*b* on the rectangular plate 32 and the ceiling wall portion 33*c*.

In addition, as shown in FIG. 1, the automatic transfer apparatus 1 is provided with the displacement restricting means 35 that restricts lateral displacement of the carriage 4 with respect to the running direction thereof when the carriage tractor 3 runs in the traverse direction converted from the forward-reverse direction while towing the carriage 4.

The displacement restricting means 35 is structured by including a pair of carriage position holding guides 36, 36 that makes contact with both lateral surfaces of the shorter sides of the carriage body 24 of the carriage 4, on the traverse guide path 2*b* along which the carriage tractor 3 runs in the traverse direction while towing the carriage 4.

The each carriage position holding guide 36 is composed of: a guide plate 36*a* that is arranged upright from the floor surface of the traverse guide path 2*b* and extends in the same direction as that of the travel magnetic tape 2 (traverse guide path 2*b*); and rotatable rollers 36*b* that are provided as a plurality on the surface of the guide plate 36*a* along the direction in which the travel magnetic tape 2 extends and make contact with one side of the lateral surfaces of the shorter sides of the carriage body 24 of the carriage 4.

Next, operation of the automatic transfer apparatus 1 according to the embodiment of the present invention will be described based on FIG. 1.

First of all, as shown in FIG. 1A, the carriage 4 is connected to the carriage tractor 3 by respectively engaging the connecting portions 16*a* and 15 with each other, and the carriage tractor 3 runs on the travel magnetic tape 2 extending in the forward-reverse direction (forward-reverse guide path 2*a*) and on the travel indication markers while towing the carriage 4. That is, the motor 20 rotates the cam 21 to protrude from the carriage tractor body 6 the connection pin 19 of the pin driving mechanism 18 serving as the connecting portion 15 provided in the carriage tractor 3, through the cam follower 22 and the connecting member 23, and then to engage the connection pin 19 with the pin engaging hole 30 serving as the front side connecting portion 16*a* provided in the carriage body 24 of the carriage 4, thus connecting the carriage 4 to the carriage tractor 3.

Then, in the state in which the front portion of the carriage tractor 3 protrudes from the front end of the carriage 4, the carriage tractor 3 runs on the travel magnetic tape 2 extending in the forward-reverse direction and on the travel indication markers while towing the carriage 4. In this state, the two idler wheels 10*a* and 10*b* on the front side of the carriage tractor 3 are set as swivel idler wheels, and the two idler wheels 10*c* and 10*d* on the rear side of the carriage tractor 3 are set as fixed idler wheels that are fixed so as to be oriented in the forward-reverse direction.

It should be noted that, when the carriage tractor 3 runs on the travel magnetic tape 2 while towing the carriage 4, the carriage tractor 3 runs while the three magnetic detection sensors 13*a* to 13*c* of the magnetic detection sensor unit 12

(refer to FIG. 2) provided at the front portion in the forward direction of the drive wheel unit 7 are constantly detecting the travel magnetic tape 2, and, if the three magnetic detection sensors 13*a* to 13*c* are in the detection state of OFF, ON, and OFF in the corresponding order, the carriage tractor 3 is determined to be normally running and is maintained to be in that state. However, if the three magnetic detection sensors 13*a* to 13*c* are placed in the detection state of ON, OFF, and OFF in the corresponding order during running operation, the carriage tractor 3 is determined to be not normally running on the travel magnetic tape 2. In this case, the carriage tractor 3 is controlled so as to normally run on the travel magnetic tape 2 by controlling the rotational speeds of the running motors connected to the wheels 8, 8 so as to place the three magnetic detection sensors 13*a* to 13*c* in the detection state of OFF, ON, and OFF in the corresponding order.

In addition, the carriage tractor 3 runs by detecting the plurality of travel indication markers arranged at intervals along the travel magnetic tape 2 and following the travel indications thereof. For example, if the travel indication markers employ the relative addressing system, the carriage tractor 3 is installed with the traveling program in which each of the travel indications has been entered at the address number of each of the travel indication markers. Then, every time when the carriage tractor 3 passes each of the travel indication markers, the address number for the travel indication markers is counted up, and the carriage tractor 3 runs according to the travel indication corresponding to the address number of the travel indication marker passed.

Next, when the carriage tractor 3 runs in the traverse direction (traverse guide path 2*b*) converted from the forward-reverse direction (forward-reverse guide path 2*a*) while towing the carriage 4, the connection pin 19 of the carriage tractor 3 is first pulled out of the pin engaging hole 30 of the connecting portion 16*a* on the front side of the carriage 4 and retracted into the carriage tractor body 6 in the state of FIG. 1A, thereby releasing the connection between the carriage tractor 3 and the carriage 4. Subsequently, the two idler wheels 10*a* and 10*b* on the front side of the carriage tractor 3 are switched to be the fixed idler wheels that are fixed in the state of being oriented in the forward-reverse direction, and, in the state in which all of the idler wheels 10*a* to 10*d* of the carriage tractor 3 are set as the fixed idler wheels, the carriage tractor 3 is moved in the reverse direction along the travel magnetic tape 2 in the forward-reverse direction so as to arrange the substantial center of the drive wheel unit 7 in the position of the travel magnetic tape 2 forming the traverse guide path 2*b*, as shown in FIG. 1B. In this position, the connection pin 19 of the pin driving mechanism 18 composing the connecting portion 15 of the carriage tractor 3 is engaged with the pin engaging hole 30 of the connecting portion 16*b* on the rear side of the carriage 4, thereby connecting the carriage 4 to the carriage tractor 3.

Next, as shown in FIG. 1C, while differentiating the rotational speeds of the wheels 8, 8 of the drive wheel unit 7 of the carriage tractor 3, the direction of the drive wheel unit 7 is turned counterclockwise to be converted by approximately 90° from the forward-reverse direction to the traverse direction. In this case, as shown in FIG. 2, the direction of the drive wheel unit 7 is converted based on the detection of the travel magnetic tape 2 by the magnetic detection sensors 13*a* to 13*c* of the magnetic detection sensor unit 12 provided at the front portion in the forward direction of the drive wheel unit 7.

That is, by differentiating the rotational speeds of the wheels 8, 8 of the drive wheel unit 7 oriented in the forward-reverse direction, the wheels 8, 8 are revolved about a vertical axis from the state in which the three magnetic detection sensors 13*a* to 13*c* are in the detection state of OFF, ON, and OFF in the corresponding order, through the process in which all of the magnetic detection sensors 13*a* to 13*c* are in the detection state of OFF, until the three magnetic detection sensors 13*a* to 13*c* are placed again in the detection state of OFF, ON, and OFF in the corresponding order, thus converting the direction of the drive wheel unit 7 by approximately 90° from the forward-reverse direction to the traverse direction.

Subsequently, all of the idler wheels 10*a* to 10*d* of the carriage tractor 3 that have been set as the fixed idler wheels are newly set as the swivel idler wheels.

Next, by driving the wheels 8, 8 of the drive wheel unit 7 of the carriage tractor 3, the carriage tractor 3 is run from the position of FIG. 1C to the position of FIG. 1D together with the carriage 4.

Then, the carriage tractor 3 runs in the traverse direction towing the carriage 4, while all of the idler wheels 10*a* to 10*d* of the carriage tractor 3 that are newly set as the swivel idler wheels and all of the idler wheels 25*a* to 25*d* of the carriage 4 that have already been set as the swivel idler wheels are oriented in the same direction (traverse direction) as that of the drive wheel unit 7. At this time, although a lateral displacement operation occurs in the carriage tractor 3 and the carriage 4 with respect to the running direction thereof, the both lateral surfaces of the shorter sides of the carriage 4 are made contact with the pair of carriage position holding guides 36, 36, that is, the rotatable rollers 36*b*, 36*b* that are provided as a plurality on the surfaces of the pair of guide plates 36*a*, 36*a* along the direction of the traverse guide path 2*b*. Therefore, the carriage tractor 3 and the carriage 4 run in the traverse direction without being laterally displaced with respect to the running direction thereof.

Next, after the carriage tractor 3 and the carriage 4 complete to run in the traverse direction, the direction of the drive wheel unit 7 is turned clockwise to be converted by approximately 90° from the traverse direction to the forward-reverse direction while differentiating again the rotational speeds of the wheels 8, 8 of the drive wheel unit 7 of the carriage tractor 3, as shown in FIG. 1D.

That is, the wheels 8, 8 are revolved about the vertical axis from the state in which the three magnetic detection sensors 13*a* to 13*c* are in the detection state of OFF, ON, and OFF in the corresponding order, through the process in which all of the magnetic detection sensors 13*a* to 13*c* are in the detection state of OFF, until the three magnetic detection sensors 13*a* to 13*c* are placed again in the detection state of OFF, ON, and OFF in the corresponding order, thus converting the direction of the drive wheel unit 7 by approximately 90° from the traverse direction to the forward-reverse direction.

Figure 6:
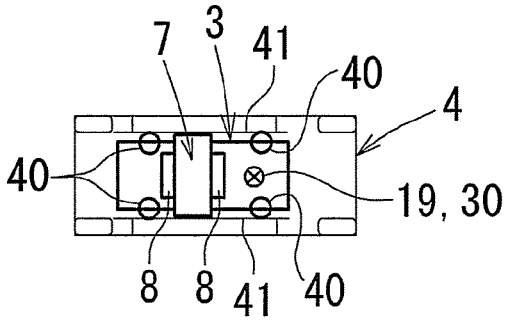
FIG. 6 is a schematic diagram showing another embodiment different from that of FIG. 1 in terms of connection mode between the carriage tractor and the carriage.

Next, from the state of FIG. 1D, the connection pin 19 of the carriage tractor 3 is pulled out of the pin engaging hole 30 of the connecting portion 16*b* on the rear side of the carriage 4 and retracted into the carriage tractor body 6, thereby releasing the connection between the carriage tractor 3 and the carriage 4. Subsequently, if, for example, the carriage 4 is provided with guide plates 41, 41 on the inner sides thereof and the carriage tractor 3 is provided with rotatable rollers 40, 40 as shown in FIG. 6, the carriage tractor 3 is slightly moved in the reverse direction along the guide plates 41, 41 (along the inner sides of the carriage 4) by driving the drive wheel unit 7, and all of the idler wheels 10*a* to 10*d* of the carriage tractor 3 are revolved by 90° so as to be oriented in the forward-reverse direction. Then, the two idler wheels 10*c* and 10*d* on the rear side are switched to be the fixed idler wheels, and the two idler wheels 10*a* and 10*b* on the front side are left to be the swivel idler wheel. Note that, as shown in FIG. 1D, if the travel magnetic tape 2 extends also in the reverse direction, the carriage tractor 3 may be slightly moved in the reverse direction along the travel magnetic tape 2 (based on magnetic information). Subsequently, as shown in FIG. 1E, the carriage tractor 3 is moved forward along the travel magnetic tape 2 extending in the forward-reverse direction to a position in which the front portion of the carriage tractor 3 protrudes from the front end of the carriage 4 and the connection pin 19 of the carriage tractor 3 can be engaged with the pin engaging hole 30 of the connecting portion 16*a* on the front side of the carriage 4. Next, the connection pin 19 of the carriage tractor 3 is protruded from the carriage tractor body 6 and engaged with the pin engaging hole 30 of the connecting portion 16*a* on the front side of the carriage 4, thereby connecting the carriage 4 to the carriage tractor 3.

Then, as shown in FIG. 1F, by driving the drive wheel unit 7, the carriage tractor 3 starts to run along the travel magnetic tape 2 extending in the forward-reverse direction (forward-reverse guide path 2*a*) while towing the carriage 4.

As described above, in the automatic transfer apparatus 1 according to the embodiment of the present invention, the carriage tractor 3 is provided with the connection pin 19 (connecting portion 15) that is connected to the carriage 4 near the substantial center of the bottom of the carriage 4, and, on the other hand, the carriage 4 is provided with the pin engaging hole 30 (connecting portion 16*b*) that is connected to the carriage tractor 3 near the substantial center of the bottom of the carriage 4. In addition, the traverse guide path 2*b* that allows the carriage tractor 3 to run in the traverse direction is provided with the pair of carriage position holding guides 36, 36 (displacement restricting means 35) that restricts the lateral displacement of the carriage 4 with respect to the running direction thereof when the carriage tractor 3 runs in the traverse direction while towing the carriage 4.

Consequently, in the automatic transfer apparatus 1, when the carriage tractor 3 runs in the traverse direction (traverse guide path 2*b*) converted from the forward-reverse direction (forward-reverse guide path 2*a*) while towing the carriage 4, the carriage tractor 3 and the carriage 4 run in a manner being restricted in lateral displacement with respect to the direction of running in the traverse direction. Thus, the carriage tractor 3 is capable of running in the forward-reverse direction and the traverse direction while simplifying and downsizing the carriage tractor 3 without complicating the structure thereof.

Figure 5:
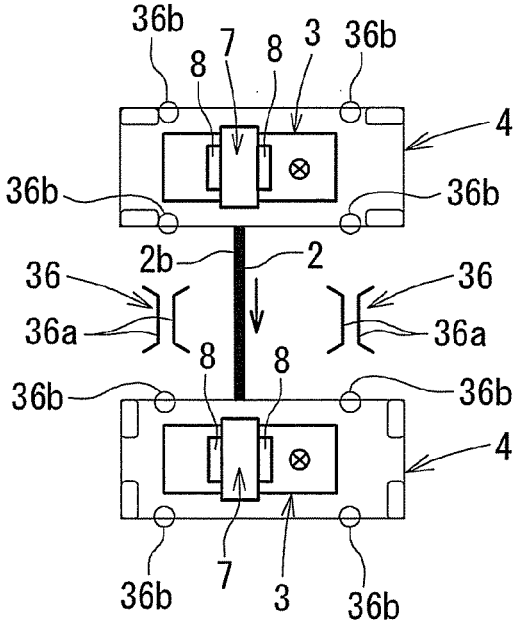
FIG. 5 is a schematic diagram showing another embodiment in which a pair of carriage position holding guides provided in the automatic transfer apparatus is different from those of FIG. 1.

Note that, in the automatic transfer apparatus 1 according to the embodiment of the present invention, as shown in FIG. 1, the pair of carriage position holding guides 36, 36 composing the displacement restricting means 35 is composed of: the pair of guide plates 36*a*, 36*a* that is arranged upright from the floor surface of the traverse guide path 2*b* and extends in the same direction as that of the travel magnetic tape 2; and the rotatable rollers 36*b* that are provided as a plurality on each surface of the guide plates 36*a*, 36*a* along the direction in which the travel magnetic tape 2 extends and make contact with the both lateral surfaces of the shorter sides of the carriage 4. However, as shown in FIG. 5, the pair of carriage position holding guides 36, 36 may be composed of a pair of guide plates 36*a*, 36*a* that is arranged upright from the floor surface on both sides of the traverse guide path 2*b* across the travel magnetic tape 2 and extends in the same direction as the travel magnetic tape 2 extends, and rotatable rollers 36*b*, 36*b* that are respectively provided as two rollers at the front side and the rear side of the carriage 4 and roll along inside of the guide plates 36*a*, 36*a*.

In addition, although the pair of carriage position holding guides 36, 36 is structured in a manner making contact with the both lateral surfaces of the shorter sides of the carriage 4 so as to hold the position of the carriage 4, the guides 36, 36 may be structured in a manner making contact with the both lateral surfaces of the shorter sides of the carriage tractor 3 so as to hold the position of the carriage tractor 3.

Moreover, in the automatic transfer apparatus 1 according to the embodiment of the present invention, when the carriage tractor 3 runs in the traverse direction while towing the carriage 4, the connection pin 19 of the pin driving mechanism 18 provided in the carriage tractor 3 is engaged with the pin engaging hole 30 of the pin engaging member 31 provided near the substantial center of the bottom of the carriage 4, thus connecting the carriage tractor 3 with the carriage 4 by the engagement at one place. However, engaging means for engaging between the carriage tractor 3 and the carriage 4 may employ either of two modes shown in FIGS. 6 and 7.

That is, as shown in FIG. 6, in addition to the way in which the connection pin 19 of the pin driving mechanism 18 built into the carriage tractor 3 is engaged with the pin engaging hole 30 of the pin engaging member 31 provided near the substantial center of the bottom of the carriage 4, two of the rotatable rollers 40, 40 may be provided at each of the front side and the rear side of both lateral surfaces of the longer sides of the carriage tractor 3, and the guide plates 41, 41 contacted by the rotatable rollers 40, 40 provided in the carriage tractor 3 may be provided as a pair on the inner sides of the carriage 4.

Figure 7:
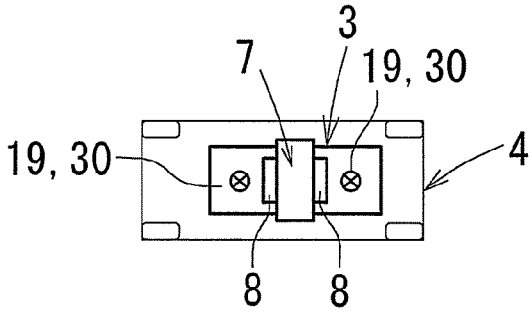
FIG. 7 is a schematic diagram showing another embodiment different from the embodiments of FIGS. 1 and 6 in terms of connection mode between the carriage tractor and the carriage.

Alternatively, as shown in FIG. 7, the connection pin 19 of the pin driving mechanism 18 built into the carriage tractor 3 may be provided at each of two places on the front side and the rear side of the drive wheel unit 7 located at the substantial center of the bottom of the carriage tractor 3, and on the other hand, also in the carriage 4, two pin engaging holes 30, 30 of pin engaging members 31, 31 may be provided in two positions corresponding to the connection pins 19, 19, thereby connecting the carriage tractor 3 with the carriage 4 at the two places near the substantial center of the bottom of the carriage 4.

By structuring the engaging means as described above, when the carriage tractor 3 runs in the traverse direction while towing the carriage 4, integration between the carriage tractor 3 and the carriage 4 can be further enhanced than that in the mode in which the carriage tractor 3 and the carriage 4 are connected by engaging the connection pin 19 of the carriage tractor 3 with the pin engaging hole 30 near the substantial center of the bottom of the carriage 4, as shown in FIG. 1. Therefore, when the carriage tractor 3 runs in the traverse direction while towing the carriage 4, the lateral displacement of the carriage tractor 3 can also be restricted in a reliable manner by restricting the lateral displacement of the carriage 4 with respect to the running direction thereof by using the pair of carriage position holding guides 36, 36.

Figure 8:
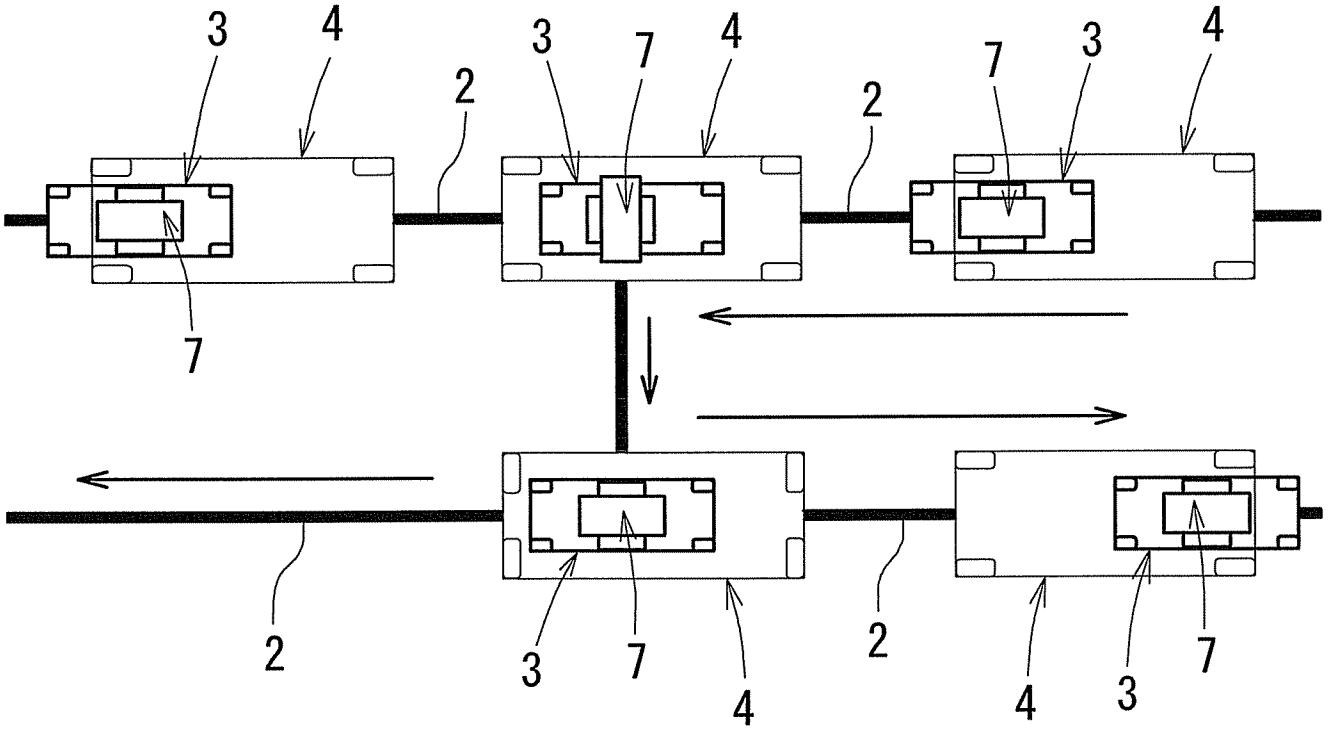
FIG. 8 is a diagram showing an example of a running way on which the carriage tractor can run.

Note that, in the automatic transfer apparatus 1 according to the embodiment of the present invention, if the travel magnetic tape 2 is laid on the floor surface in the shape of H as shown in FIG. 8, the carriage tractor 3 can run not only in a crank-shaped manner as a matter of course, but also in a U-shaped manner, thus enabling the carriage tractor 3 to run in a small space.

The invention claimed is:

1. An automatic transfer apparatus, comprising:

a self-propelled transfer vehicle that runs, by using a travel magnetic tape and a travel indication marker laid along a predetermined path, along the predetermined path in a forward-reverse direction and in a traverse direction, a carriage having a carriage body including short and long sides, wherein the self-propelled transfer vehicle is changed from the forward-reverse running direction to the traverse direction without turning the carriage body, at least two connecting portions disposed on the carriage, each configured to connect to a connecting portion disposed on the self-propelled transfer vehicle wherein the connecting portion on the self-propelled transfer vehicle is connected to a first carriage connecting portion and disconnected from a second carriage connecting portion when the vehicle runs in the forward-reverse direction, and wherein the connecting portion on the self-propelled transfer vehicle is connected to the second carriage connecting portion and disconnected from the first carriage connecting portion when the vehicle runs in the traverse direction a displacement restricting device that restricts lateral displacement of the carriage in its running direction when the self-propelled transfer vehicle runs in the traverse direction, wherein the displacement restricting device is provided with a pair of carriage position holding guides that hold a position of the carriage on a traverse guide path along which the self-propelled transfer vehicle runs in the transverse direction, and a drive wheel provided at the self-propelled transfer vehicle which is composed of a drive wheel unit having a pair of right and left wheels rotating independently of each other, wherein the drive wheel unit is provided at one place in a substantial center of the bottom of the self-propelled transfer vehicle, and wherein a direction of the drive wheel unit is converted by differentiating rotational speeds of each of the wheels.

2. The automatic transfer apparatus according to claim 1, wherein a detecting sensor detecting the travel magnetic tape is built into a front portion or a rear portion of a drive wheel in a forward direction, and, based on detection of the travel magnetic tape by the detecting sensor, a direction of the drive wheel is converted to either the forward-reverse direction or the traverse direction.

3. The automatic transfer apparatus according to claim 1, wherein the self-propelled transfer vehicle is a carriage tractor that tows the carriage, and the carriage connecting portions are disposed near the substantial center of the bottom of the carriage.

4. The automatic transfer apparatus according to claim 1, wherein the carriage position holding guides are composed of: a pair of guide plates that is arranged upright from each side of a floor surface of the traverse guide path through the travel magnetic tape and extends in the same direction as that of the travel magnetic tape; and a plurality of rotatable rollers that are provided on a surface of the guide plates along a direction in which the travel magnetic tape extends and make contact with each lateral surface of the shorter sides of the carriage body of the carriage.

5. The automatic transfer apparatus according to claim 1, wherein the carriage position holding guides are composed of: a pair of guide plates that is arranged upright from each side of a floor surface of the traverse guide path through the travel magnetic tape and extends in the same direction as that of the travel magnetic tape; and a pair of rotatable rollers that is provided at a front and a back of the carriage along a direction in which the travel magnetic tape extends, the rotatable rollers each rotated along the pair of guide plates.

* * * * *

UNITED STATES PATENT AND TRADEMARK OFFICE

CERTIFICATE OF CORRECTION

PATENT NO. : 8,613,339 B2
APPLICATION NO. : 12/676872
DATED : December 24, 2013
INVENTOR(S) : Hiroyoshi Baba It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 529 days.

Signed and Sealed this
Twenty-second Day of September, 2015

Michelle K. Lee

Michelle K. Lee
*Director of the United States Patent and Trademark Office*